US011499513B2

(12) United States Patent
Pirkl et al.

(10) Patent No.: US 11,499,513 B2
(45) Date of Patent: Nov. 15, 2022

(54) INJECTOR FOR INJECTING FUEL

(71) Applicant: LIEBHERR-COMPONENTS DEGGENDORF GMBH, Deggendorf (DE)

(72) Inventors: Richard Pirkl, Regensburg (DE); Razvan-Sorin Stinghe, Hengersberg (DE); Markus Höellbacher, Puch (AT); Alexander Preis, Regen (DE); Michael Schmid, Bischofsmais (DE); Thomas Atzkern, Augsburg (DE)

(73) Assignee: LIEBHERR-COMPONENTS DEGGENDORF GMBH, Deggendorf (DE)

( * ) Notice: Subject to any disclaimer, the term of this patent is extended or adjusted under 35 U.S.C. 154(b) by 153 days.

(21) Appl. No.: 17/048,534

(22) PCT Filed: Apr. 17, 2019

(86) PCT No.: PCT/EP2019/059954
§ 371 (c)(1),
(2) Date: Oct. 16, 2020

(87) PCT Pub. No.: WO2019/202008
PCT Pub. Date: Oct. 24, 2019

(65) Prior Publication Data

US 2021/0164429 A1 Jun. 3, 2021

(30) Foreign Application Priority Data

Apr. 18, 2018 (DE) ..... 10 2018 109 206.7

(51) Int. Cl.
*F02M 47/02* (2006.01)
*F02M 63/00* (2006.01)

(52) U.S. Cl.
CPC ..... *F02M 47/027* (2013.01); *F02M 63/0029* (2013.01); *F02M 63/0035* (2013.01); *F02M 63/0071* (2013.01); *F02M 2547/008* (2013.01)

(58) Field of Classification Search
CPC ..... F02M 47/027; F02M 63/0029; F02M 63/0035; F02M 63/0071; F02M 2547/008
See application file for complete search history.

(56) References Cited

U.S. PATENT DOCUMENTS

2009/0065614 A1 3/2009 Ganser

FOREIGN PATENT DOCUMENTS

DE 19516565 A1 11/1996
DE 102013225107 A1 6/2015
(Continued)

OTHER PUBLICATIONS

ISA European Patent Office, International Search Report Issued in Application No. PCT/EP2019/059954, dated Jul. 2, 2019, WIPO, 2 pages.

*Primary Examiner* — Jacob M Amick
*Assistant Examiner* — Charles J Brauch
(74) *Attorney, Agent, or Firm* — McCoy Russell LLP

(57) ABSTRACT

A fuel injector having a seat plate with a passage throttle; a valve insert arranged at a first side of the seat plate; a valve guide surrounding the valve insert and adapted for slidable reception of the valve insert; a spring sheath surrounding at least a section of a jet needle arranged at a second side of the valve insert, the second side opposite the first side and the seat plate; a valve chamber fluidly connected to the passage throttle; a control chamber adapted for reception of fuel; and a line arranged in the valve insert connecting the control chamber and the valve chamber to one another, wherein the line is closeable by placement of the valve insert onto the spring sheath.

20 Claims, 9 Drawing Sheets

(56) References Cited

FOREIGN PATENT DOCUMENTS

| | | | | | |
|---|---|---|---|---|---|
| EP | 1991773 | B1 | | 5/2013 | |
| EP | 2818690 | A1 | | 12/2014 | |
| WO | 2005019637 | A1 | | 3/2005 | |
| WO | 2010088781 | A1 | | 8/2010 | |
| WO | WO-2010088781 | A | * | 8/2010 | ..... F02M 45/08 |
| WO | 2016041739 | A1 | | 3/2016 | |

* cited by examiner

Section rotated by 90°

Position 3 (control chamber and valve chamber connected via discharge throttle)

Position 4 (control chamber and valve chamber connected via discharge throttle)

INJECTOR FOR INJECTING FUEL

CROSS REFERENCE TO RELATED APPLICATIONS

The present application is a U.S. National Phase of International Patent Application Serial No. PCT/EP2019/059954 entitled "INJECTOR FOR INJECTING FUEL," and filed on Apr. 17, 2019. International Patent Application Serial No. PCT/EP2019/059954 claims priority to German Patent Application No. 10 2018 109 206.7 filed on Apr. 18, 2018. The entire contents of each of the above-listed applications are hereby incorporated by reference for all purposes.

TECHNICAL FIELD

The present disclosure relates to an injector for injecting fuel.

BACKGROUND AND SUMMARY

In internal combustion engines such as diesel engines or also gasoline engines, a fuel is as a rule injected via an injector into a combustion chamber in a specific quantity and for a specific time period. It is necessary in this process due to the very small injection times that are in the microsecond range to open or close the outlet opening of the injector at a very high frequency.

Since the basic functional principle of an injector is familiar to the skilled person, some aspects that are of advantage for the understanding of the invention will only be looked at briefly in the following.

An injector typically has a jet needle (also: injector needle) that allows a highly compressed fuel to exit outwardly on release of a discharge hole of the injector. This jet needle acts in cooperation with this outlet opening as a plug that enables an exit of the fuel when raised. It is therefore accordingly necessary to raise this needle at relatively short time intervals and to allow it to slide back into the outlet opening after a brief period. In this respect, hydraulic servo valves can be used that control the triggering of this movement. Such valves are in turn controlled with the aid of an electromagnet.

Due to the high injection pressures of more than 2500 bar, it is not possible to control or to move the jet needle directly with the aid of a magnetic valve. The required forces for opening and closing the jet needle would be too great here so that such a process would only be able to be implemented with the aid of very large electromagnets. Such a design is, however, excluded due to the only limited available installation space in an engine.

So-called servo valves that control the jet needle and are themselves controlled via an electromagnetic valve are typically used instead of the direct control. In this respect, a pressure level that acts on the jet needle in the closure direction is built up in a control chamber interacting with the jet needle with the aid of the available highly compressed fuel. This control chamber is typically connected to the high pressure region of the fuel via a feed line. This control chamber (also: lower control chamber) further has a line to a valve chamber (also: upper control chamber) that has a closable discharge throttle from which the high pressure fuel can escape toward a low pressure region. When it does this, the pressure in the valve chamber and in the control chamber falls, whereby the closure force acting on the jet needle is reduced since the high pressure fuel of the valve chamber and of the control chamber can flow off. A movement of the jet needle is thereby produced that releases the outlet opening at the injector tip. To be able to control the movement of the jet needle, the discharge throttle in the seat plate of the injector of the valve is selectively closed or opened with the aid of an armature element.

The pilot valve comprising the armature element and the discharge throttle of the seat plate is in turn able to be moved into the desired position with the aid of an electromagnet. If the electromagnet is in a deenergized state, a certain spring force is required that presses the armature element toward the discharge throttle (=opening of the throttle bore in the seat plate). In an energized state of the electromagnet, the armature element is drawn against the spring force exerted by the spring element so that a compression of the spring occurs and releases the discharge throttle in the seat plate.

As already briefly explained, the high pressure fuel therefore flows via the throttle bore of the seat plate into a low pressure region. There is thereby not only a pressure drop in the valve chamber (also: upper control chamber), but—due to the line connecting the valve chamber and the control chamber (also: lower control chamber)—also in the control chamber adjacent to the jet needle. The pressure reduction in the control chamber has the result of raising the jet needle out of its nozzle seat.

A fuel injection valve of the category is known from EP 1991773 B 1. A 3/2 way control device is implemented here. The known control device is formed in multiple parts and has a control valve having a valve insert led in a valve guide. A discharge throttle that permanently connects the regions of the valve chamber and of the control chamber divided by the control valve is arranged in the valve insert. In this embodiment, fuel can be permanently exchanged between the valve chamber and the control chamber via the discharge throttle.

It is the object of the present disclosure to further develop an injector for injecting fuel such that the hydraulic efficiency in the intermittent injection of the fuel into the combustion chamber is improved and such that the opening of the jet needle can take place faster in comparison with the prior art.

This is done using an injector in accordance with the invention that has all the features of the described embodiments. The injector for injecting fuel accordingly comprises a seat plate having a passage throttle, a valve insert that is arranged at one of the areal sides of the seat plate, a valve guide for a slidable reception of the valve insert, a jet needle that is arranged at the side of the valve insert disposed opposite the seat plate, a spring sheath that surrounds a section of the jet needle, a valve chamber for the reception of fuel, wherein the valve chamber is bounded by the seat plate and the valve insert and extends up to the passage throttle of the seat plate, a control chamber for the reception of fuel, wherein the control chamber is bounded by the valve insert, the spring sheath, and the jet needle, and a line that connects the control chamber and the valve chamber to one another, wherein the line is arranged in the valve insert. Various described embodiments are inter alia characterized in that the line is closed by a placement of the valve insert onto the spring sheath.

It can thereby be ensured on a filling of the control chamber with high pressure fuel that the introduced fuel does not flow off into the valve chamber via the line, but rather remains in the control chamber and results in a faster reaction of the jet needle on the opening—in comparison with a permanent connection of the control chamber and the valve chamber.

It is further of advantage that the closing of the line connecting the control chamber and the valve chamber does not require any further component. A ball that is arranged in the line and that forms a check valve for fuel would be conceivable, for example. Such an arrangement would be inferior to the described embodiments with respect to its fatigue strength.

Preferred embodiments of the solution in accordance with the present disclosure result from the aspects of the described embodiments.

The spring sheath is preferably directly adjacent to the valve guide.

Provision is made in accordance with an optional modification that the spring sheath substantially has a blind hole type cutout for the reception of the jet needle and has at least one connection line to fluidically connect the interior of the blind hole type cutout in which the jet needle is arranged to a side of the valve insert facing the spring sheath.

The spring sheath can accordingly here have a cylindrical design that is closed at one side. The jet needle extends out of the cylindrically designed spring sheath on the other side. The closed side of the cylindrical design is here only provided by means of connection lines that enable a fluidic connection of a side of the valve insert facing the spring sheath into the interior of the spring sheath.

Provision can furthermore be made that the spring sheath has a planar placement surface for the placement of the valve insert that, on a placement of the valve seat, closes the line in interaction with a contact surface of the valve cap surrounding an opening of the line. This planar region accordingly represents a flat seat that serves the placement of the valve insert on the spring sheath.

Provision is made in accordance with a further advantageous design that the spring sheath has a surface that faces the valve insert, that is substantially planar, and that is only interrupted by the at least one connection line into the interior of the spring sheath.

The control chamber of the injector accordingly comprises two regions that are separated from one another by the spring sheath. A connection between the regions only takes place via the at least one connection line in the spring sheath.

Provision is preferably made that the placement of the valve insert on the spring sheath takes place in a plane perpendicular to the axis of rotation of the jet needle.

Furthermore, in the described embodiments, the control chamber can comprise two regions or can consist of two regions that are only connected to one another by at least one connection line extending in the spring sheath.

The at least one connection line is preferably a bore that can extend in parallel with the longitudinal direction of the jet needle.

Provision is made in accordance with a further optional modification that a region for the placement of the valve insert on the spring sheath is a flat seal that closes the line extending in the valve insert in a placed state of the valve insert on the spring sheath.

A sealing of the line that connects the control chamber and the valve chamber to one another is possible in a reliably manner by the provision of the flat seal. The basic principle of action here substantially corresponds to the placement of the armature on the throttle opening of the seat plate.

The valve insert preferably has a projecting step at the side facing the spring sheath and the opening of the line is arranged in its surface.

The regions on the surface of the valve insert facing the spring sheath that surround the opening are advantageously on one level so that a sealing can be place by placement onto a planar surface.

Provision can furthermore be made that the projecting step is a step-like elevation with respect to the remaining side of the valve insert facing the spring sheath so that the contact surface is reduced in size on a placement on the spring sheath. This results in a better closing procedure of the line that is arranged in the valve insert and that connects the control chamber and the valve chamber to one another.

In accordance with an optional modification of the invention, the valve guide has at least one feed line for high pressure fuel whose connection into the control chamber is open on a placement of the valve insert on the spring sheath and is closed in a state raised therefrom.

In this respect, a feed line can be opened or closed via the sliding movement of the valve insert. This is done via the abutment of the valve insert at the lower margin of the valve guide that interrupts a connection of the feed line to the control chamber.

The valve insert is furthermore formed as mushroom shaped in accordance with an advantageous embodiment. The mushroom head can face the spring sheath here.

The line is preferably a discharge throttle for fuel from the control chamber into the valve chamber.

Provision can furthermore be made that the valve insert is rotationally symmetrical about a bore axis of the line.

In accordance with a further advantageous embodiment, the spring sheath is rotationally symmetrical about the axis of rotation of the jet needle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

Further details, features, and advantages of the described embodiments will be explained with reference to the following description of the Figures.

Similar reference numerals may have been used in different figures to denote similar components. FIG. 1 is shown approximately to scale, according to some embodiments.

FIGS. 1, 3A-B, and 4A-E are shown with components in proportional size with one another, according to some embodiments.

DETAILED DESCRIPTION

Figure 1:
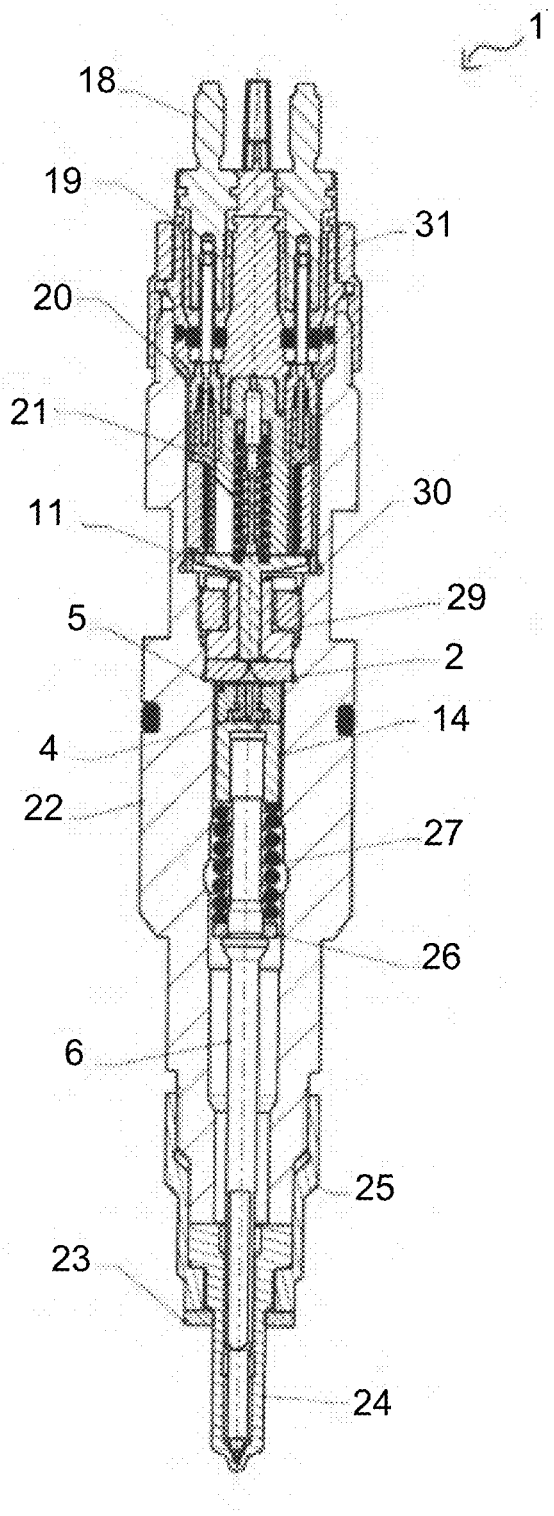
FIG. 1 shows a sectional view of an injector for fuel injection.

FIG. 1 shows a sectional view of an injector for injecting fuel.

The injector 1 here comprises a housing 22 that is provided with a closure cap 31 at the end remote from the nozzle 24. The electric connections 18 for controlling the injector 1 extend out of the closure cap 31. The connections 18 are connected to an electromagnet 19 that raises the armature 11 out of the sealing position of the passage throttle of the seat plate 2 against the spring force of the compression spring 21 in the energized state. The compression spring 21 here contacts a shim 20 at its end remote from the armature 11. The armature 11 is here surrounded by the armature guide 29 at which a pressure screw 30 is adjacent.

The region above the seat plate 2, that extends, starting from the passage throttle of the seat plate 2, toward the armature 11 is here the low pressure region of the injector 1. The high pressure region of the injector 1 extends, starting from the throttle bore of the seat plate 2, toward the nozzle 24.

The valve guide 5 and the valve insert 4 received therein are adjacent to the side of the seat plate 2 opposite the armature 11. The compression spring 27 that serves to urge the jet needle 6 into its closed position via a shim 26 placed on a protrusion of the jet needle 6 engages at the adjoining spring sheath 28, The nozzle clamping nut 25 and the sealing washer 23 complete the design of the injector 1.

FIGS. 2A-D show an enlarged representation of an injector in the region around its seat plate 2. It must be noted here that these Figures do not have the characterizing feature of the present described embodiments. For better understanding, force arrows and flow arrows for the path of the fuel are drawn in the Figures.

Figure 2A:
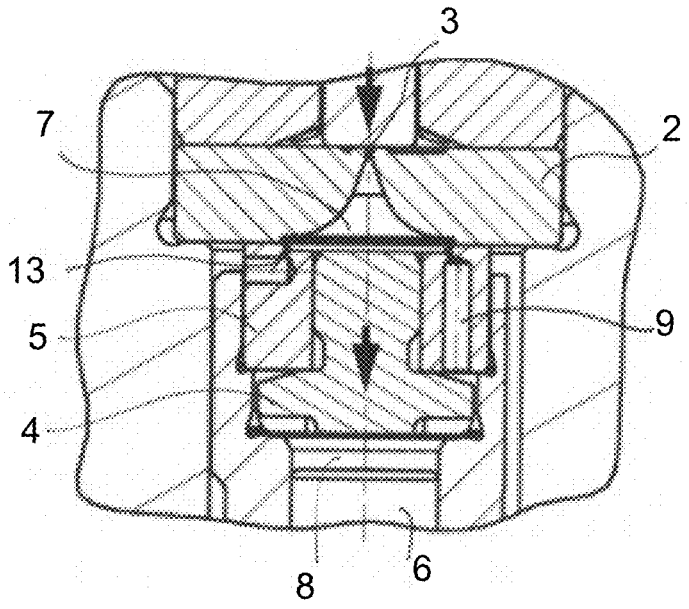
FIGS. 2A-D show an enlarged detail around the seat plate of the injector in different states of an injector cycle.

FIG. 2A shows a state in which the pilot valve (that is the armature 11 and the passage throttle 3) is closed and no injection takes place. In that starting state, the same pressure relationships are present both in the valve chamber 7 and in the control chamber 8 due to the inflow of fuel of high pressure via the feed throttle 13. The fuel flowing into the valve chamber 7 via the feed throttle 13 is here also conducted into the control chamber 8 via the first line 9.

In the deenergized state of the electromagnet 19, the bore 3 of the seat plate 2 is closed by the armature 11 with the aid of the preload of the compression spring 21. The armature 11 here separates the high pressure region from the low pressure region. The armature 11 is attracted and the bore 3 in the seat plate 2 is released by the control of the electromagnet 19. The pressure beneath the seat plate 2 is thus lowered and the valve insert 4 is drawn toward the lower edge of the valve guide 5.

Figure 2B:
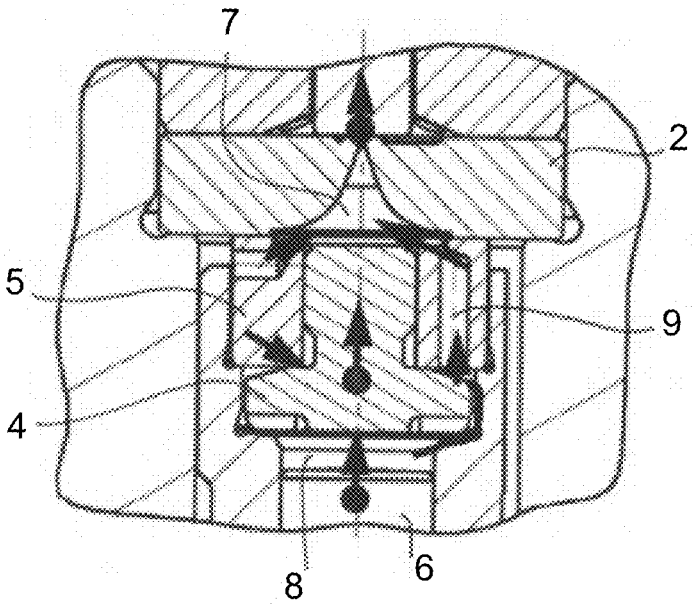

FIG. 2B now shows a state in which the pilot valve is open, that is the armature 11 is raised from the passage bore 3. An injection of fuel by means of the injector thereby takes place.

The fuel flows into the low pressure region of the injector 1 through the discharge throttle 9 (also: first line 9) in the valve guide 5 due to the pressure difference that is present. The pressure in the control chamber 8 above the jet needle 6 is thereby reduced. The needle 6 is raised from the nozzle seat and the injection begins due to the pressure drop that is thus created between the jet needle head and the jet needle body.

Figure 2C:
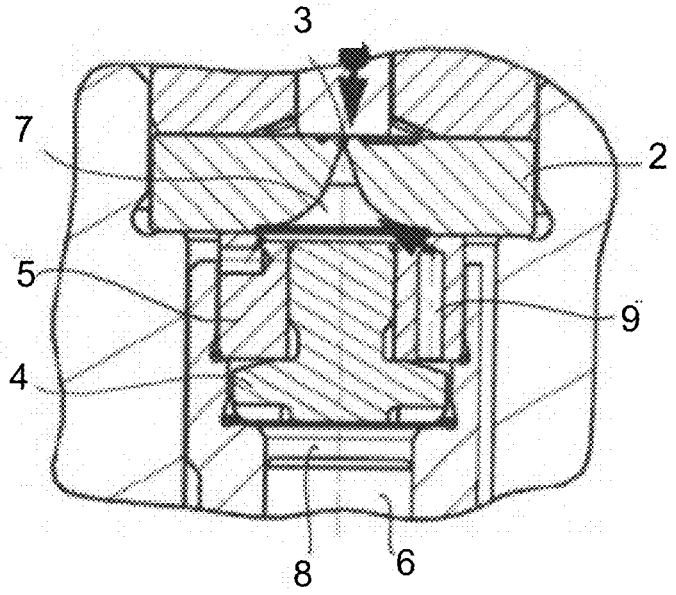

FIG. 2C shows a state in which the pilot valve is just closing, an injection of the injector 2 is, however, still present.

Therefore, as soon as the energization of the electromagnet 19 is interrupted, the return spring 21 presses the armature 11 back into the flat seat on the seat plate 2 and seals the passage throttle 3. The fuel can thereby no longer escape into the low pressure region and the pressure in the valve chamber 7 above the valve insert 4 increases (due to the continuous inflow of high pressure fuel via the feed throttle 13).

Figure 2D:
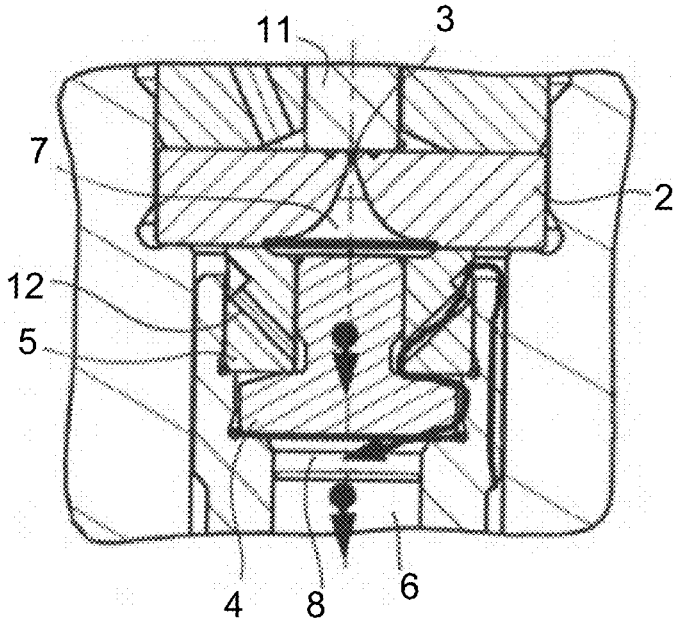

FIG. 2D shows a state in which the pilot valve is closed, the needle 6 closes, and the injection is thereby ended. The sectional plane shown is rotated with respect to the sectional planes of FIGS. 2A-C to be able to explain elements previously not shown.

Once an equilibrium of forces is achieved via the valve insert 4, the latter is pressed downward and releases the two large diagonals of filling bores 12 (also: feed lines 12) in the valve guide 5. These bores 12 form a direct connection between the high pressure volume in the injector 1 and the control chamber 8 above the injector needle 6. The pressure in the control chamber 8 thereby increases very quickly above the needle 6, which results in a fast closing of the nozzle by the needle 6. The filling bores 12 are for the function of the injector 1 here, but offer the advantage of a very fast closing of the needle 6.

Figure 3A:
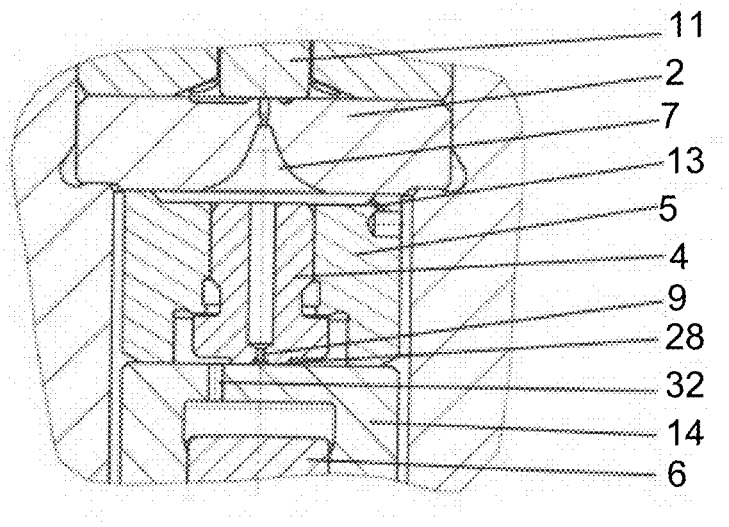
FIGS. 3A-B show an enlarged detail around the seat plate of an injector in accordance with the invention described embodiments from different view sides.
Figure 3B:
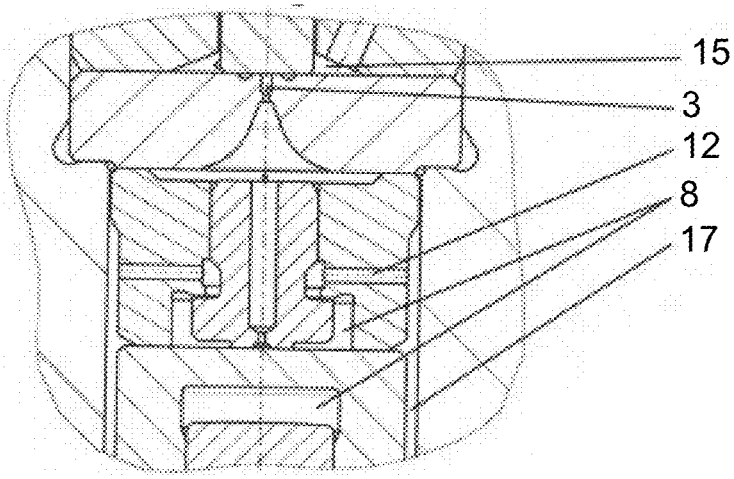

FIGS. 3A-B now show a partial region of the injector 1 in accordance with the described embodiments.

The closure element 11 here cooperates in a known manner with the passage throttle 3 of the seat plate 2. The valve chamber 7 is connected to the high pressure region via a feed throttle 13. The valve guide 5 adjoining the valve chamber 7 slidably receives the valve insert 4.

There is also a first line 9 that can connect the valve chamber 7 to the control chamber 8. The line 9 is in this respect arranged in the valve insert 4. If the valve insert 4 is movably seated in the longitudinal direction on the flat seat 28, the line 9 is blocked. A fluidic connection of the valve chamber 7 and the control chamber 8 is then not present. The jet needle arranged in the interior of the spring sheath 14 is raised with the aid of the pressure in the control chamber 8. At least one connection line 32 through the spring sheath 14 here provides that a pressure change also moves into the interior of the spring sheath 14.

FIG. 3B here shows a sectional view whose sectional plane has been rotated by 90° in comparison with the view of FIG. 3A. The feed lines 12 can now be recognized that do not have any flow communication with the control chamber 8 on an abutment of the valve guide 4 at the lower margin of the valve guide 4. If, in contrast, the valve insert 4 moves in the direction of the needle 6, a gap is produced between the lower margin of the valve guide 5 and the feed liens 13 introduce high pressure fuel into the control chamber 8. Reference numeral 17 designates the high pressure region of the fuel here.

FIGS. 4A-E all show a control valve region of the injector The control valve region is assembled from the components armature 11, seat plate 2, control valve 4, 5, the spring sheath 14, and the jet needle 6.

This assembly controls the opening and closing of the jet needle 6 and is thus decisive for the ensuring of the injector function and the performance of the injector 1. It is possible by this valve to determine the speed of the opening and closing of the jet needle 6 and its control times and thus to determine the injection duration and amount. It is possible due to the precise control to introduce targeted multiple injections during a cycle and to thereby provide a more complete combustion that in turn results in a reduction of pollutants.

The seat plate 2 in combination with the armature 11 separates the high pressure region from the magnet/leak region. The control valve 4, 5 separates the control chamber 8 from the valve chamber 7 (also: upper control chamber). It is a three-way valve, also called a mushroom valve, and is composed of the valve guide 5 and the valve insert 4.

The valve chamber 7 is delineated by the components armature 11, seat plate 2, and control valve 4, 5.

The control chamber 8 is delineated by the components control valve 4, 5, spring sheath 14, and jet needle 6. It is produced from two regions that are in communication by at least one, preferably three, axial connection bores 32 in the spring sheath 14. The control chamber volume results from the two regions and from the at least one axial connection bore 32.

The basic function will be explained in the following here with reference to FIGS. 4A-E.

Figure 4A:
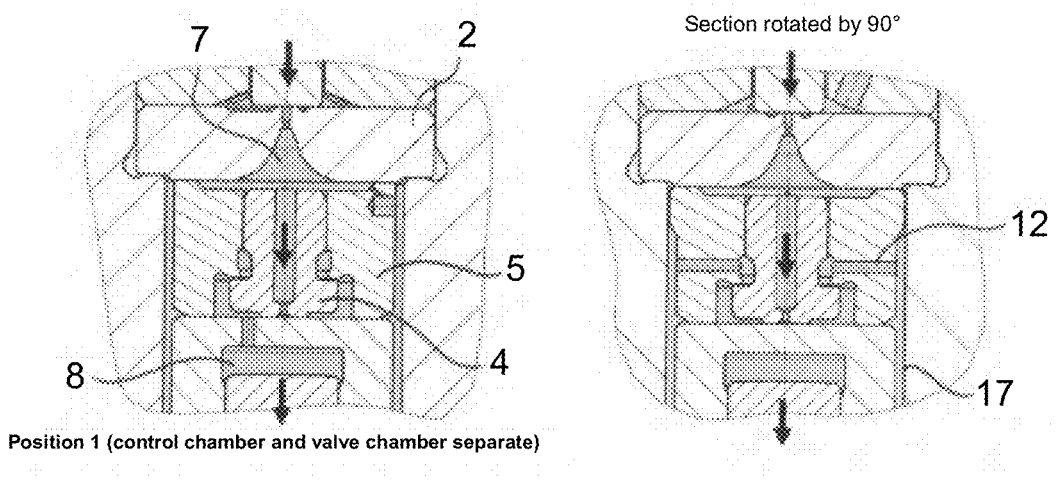
FIGS. 4A-E show an enlarged detail around the seat plate of the injector in accordance with the described embodiments in different states of the injector cycle.

It can be seen from FIG. 4A that the armature 11 closes the throttle bore 3 of the seat plate 2 in the deenergized state of the magnet 19 and prevents an outflow of the fuel from the valve chamber 7 into the leak region 15. The valve insert 4 is located at the lower abutment and lies on the flat seal 28 on the spring sheath 14. The seat plate 2 is furthermore pressed toward the injector housing 22 and provides a radial seal between the high pressure region and the leak region and between the high pressure region 17 and the valve chamber 7 due to the high surface quality and the planarity at the contact surface. There is thus no permanent leak (Position 1).

Figure 4B:
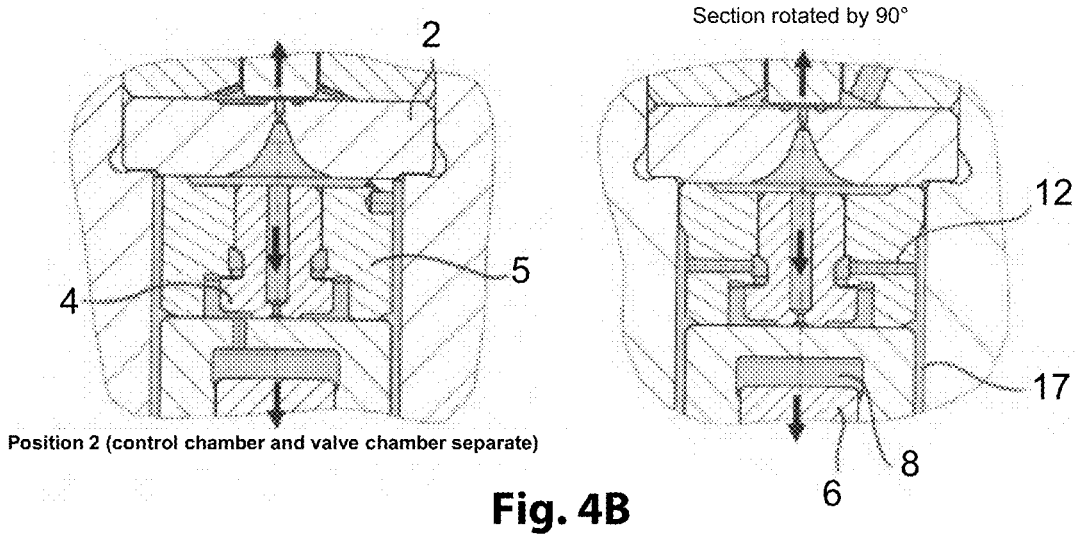

FIG. 4B shows that as soon as the magnet 19 is energized and the armature 11 is thereby raised, fuel can flow through the throttle bore 3 of the seat plate 2 out of the valve chamber 7 into the leak region 15 and thus produces a pressure drop in the valve chamber 7. A pressure difference arises between the valve chamber 7 and the control chamber 8 due to the pressure drop. As long as the valve insert 4 is at the lower abutment and the flat seat 28 on the spring sheath 14 seals, no fuel can flow onward into the valve chamber 7 via the drainage throttle 9. (Position 2).

Figure 4C:
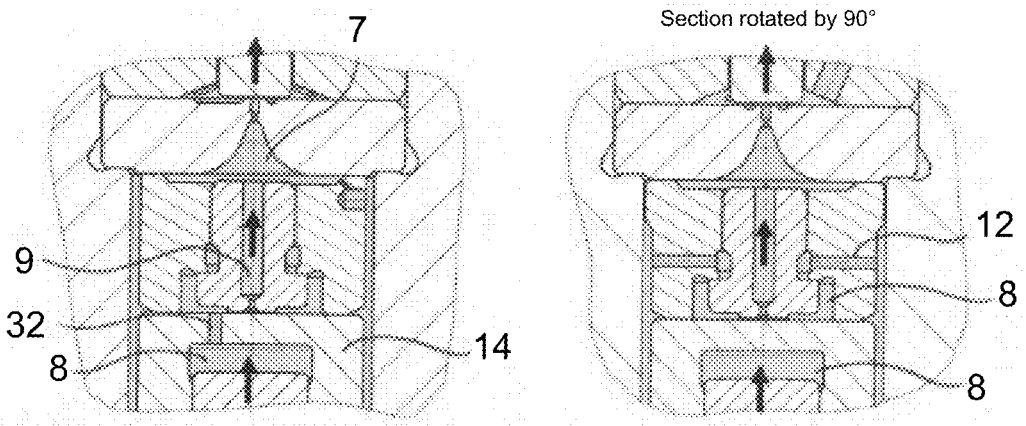

How the generated pressure difference provides that the valve insert 4 is pressed upward can be seen in FIG. 4C. If the valve insert 4 is at the upper abutment, the connection to the high pressure region 17 via the radial feed bores 12 in the valve guide 5 is sealed. Since the seal at the flat seat 28 and thus the discharge throttle 9 (also: line) is released once the valve insert 4 has moved upward, the fuel flows through the discharge throttle 9 in the valve insert 4 out of the control chamber 8 into the valve chamber 7, whereby in turn a pressure equilibrium is produced between the valve chamber 7 and the control chamber 8 (Position 3). The pressure drop in the control chamber 8 that results from this in comparison with the high pressure region 17 results in a raising of the jet needle 6, whereby the blind hole of the nozzle 24 is released and an injection of the injector 1 into the combustion chamber takes place.

Figure 4D:
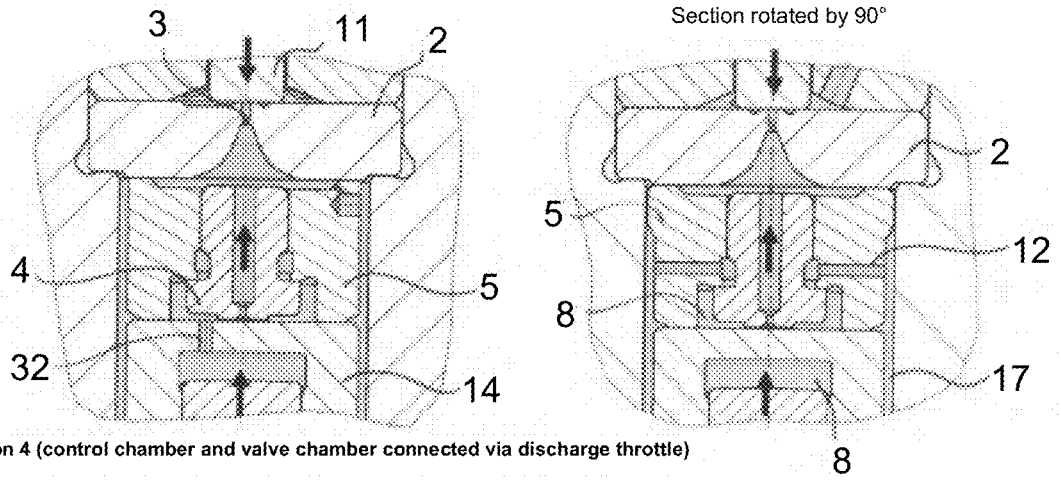

FIG. 4D shows the state as soon as the magnet 19 is no longer energized and the armature closes the throttle bore 3 of the seat plate 2.

The pressure difference between the valve chamber 7 and the control chamber 8 is adopted due to the fuel flowing out of the high pressure region 17 via the feed throttle 13 of the valve guide 5 (Position 4).

Figure 4E:
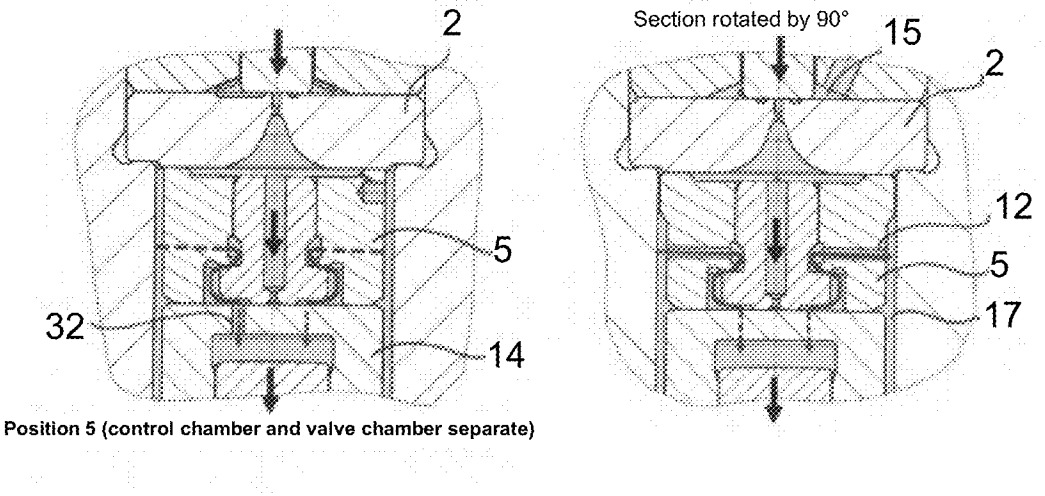

The valve insert 4 is pressed downward by the pressure buildup in the valve chamber 7 and in so doing the feed bores 12 of the valve guide 5 are released and the control chamber 8 is abruptly filled with fuel from the high pressure region 17 (Position 5, cf. FIG. 4E).

As a further consequence, the same pressure level is adopted in the valve chamber 7 and in the control chamber 8 as in the high pressure region 17. The jet needle 6 is again pressed into the seat of the nozzle body by the pressure applied in the control chamber 8 and assisted by the force of the jet needle spring 21 and thus ends the injection into the combustion chamber.

Figure 5:
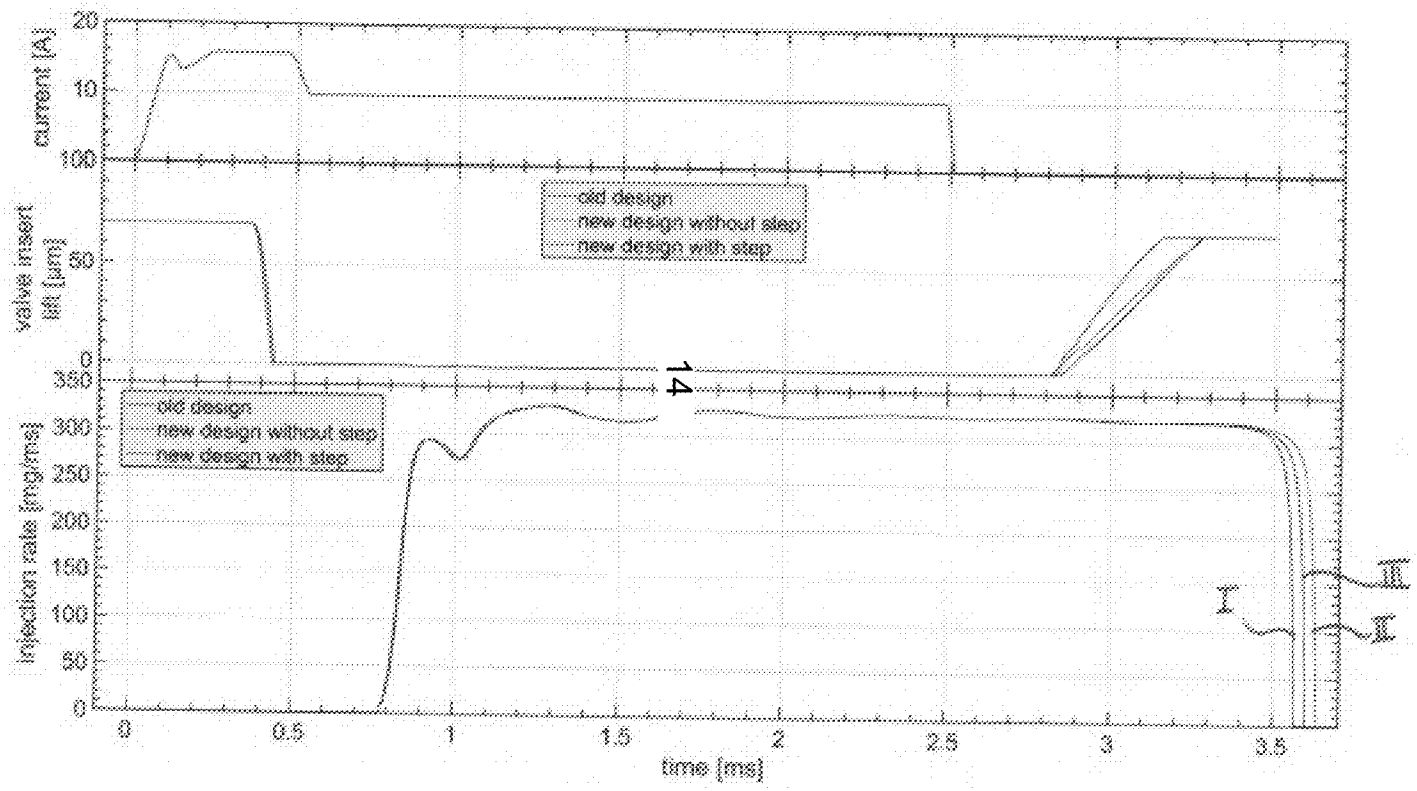
FIG. 5 shows a simulation result for the injection rate of the injector in accordance with the invention described embodiments in comparison with a conventional injector.

FIG. 5 shows the results of a simulation in comparison with a conventional injector.

It can be recognized that the valve insert of the embodiment in accordance with the invention moves faster than that of conventional injectors. The graph II is here an implementation of the invention in accordance with the invention, whereas the graph I maps a conventional injector.

Figure 6:
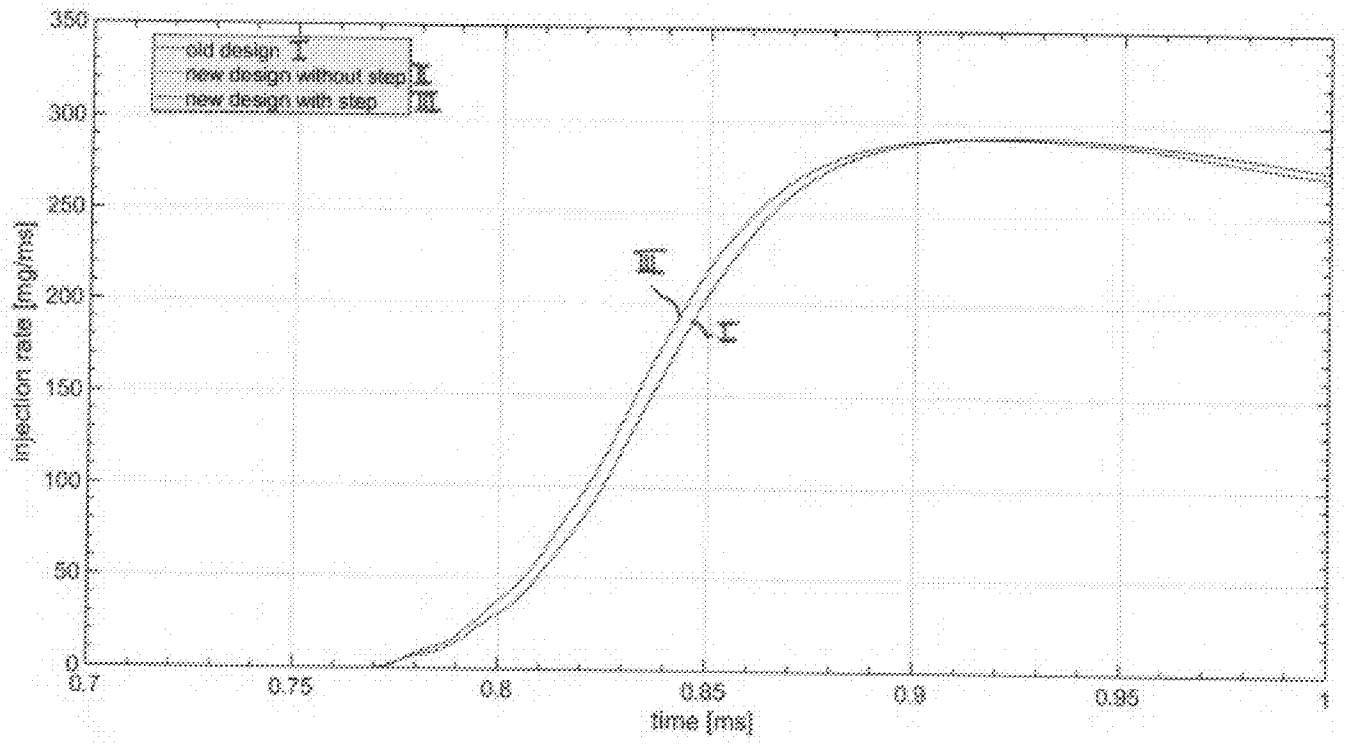
FIG. 6 shows a further simulation result for the injection rate of the injector in accordance with the invention in comparison with a conventional injector.

FIG. 6 shows that with an identical control, the injector in accordance with the described embodiments responds faster, that is has a higher injection rate in mg/ms, than a conventional injector. The graph II here shows the implementation in accordance with the described embodiments; graph I a conventional injector.

FIGS. 1, 2A-B, 3A-B, and 4A-E show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The foregoing description is considered as illustrative only of the principles of the invention. Further, since numerous modifications and changes will readily occur to those skilled in the art, it is not desired to limit the invention to the exact construction and processes shown and described herein. Accordingly, all suitable modifications and equivalents may be considered as falling within the scope of the invention as defined by the claims which follow.

REFERENCE NUMERAL LIST

1 injector
2 seat plate

3 passage throttle
4 valve insert
5 valve guide
6 jet needle
7 valve chamber
8 control chamber
9 first line
10 second line
11 closure element
12 feed line
13 feed throttle
14 spring sheath
15 leak region
16 connection bore
17 high pressure region
18 electrical connection
19 electromagnet
20 shim
21 compression spring
22 housing
23 sealing washer
24 nozzle
25 nozzle clamping nut
26 shim
27 compression spring
28 flat seat
29 armature guide
30 pressure screw
31 closure cap
32 connection line
33 step

The invention claimed is:

1. An injector for injecting fuel comprising:
a seat plate having a passage throttle;
a valve insert that is arranged at one of the areal sides of the seat plate;
a valve guide for the slidable reception of the valve insert;
a jet needle that is arranged at the side of the valve insert disposed opposite the seat plate;
a spring sheath that surrounds a section of the jet needle;
a valve chamber for the reception of fuel, wherein the valve chamber is bounded by the seat plate, the valve guide, and the valve insert and extends up to the passage throttle of the seat plate;
a control chamber for the reception of fuel, wherein the control chamber is bounded by the valve insert, the valve guide, the spring sheath, and the jet needle; and
a line that connects the control chamber and the valve chamber to one another, wherein
the line is arranged in the valve insert, and
the line is closed by a placement of the valve insert onto the spring sheath.

2. An injector in accordance with claim 1, wherein the spring sheath substantially has a blind hole type cutout for the reception of the jet needle and has at least one connection line to fluidically connect the interior of the blind hole type cutout in which the jet needle is arranged to a side of the valve insert facing the spring sheath.

3. An injector in accordance with claim 1, wherein the spring sheath has a placement surface for the placement of the valve insert that, on a placement of the valve insert, closes the line in interaction with a contact surface of the valve insert surrounding an opening of the line.

4. An injector in accordance with claim 2, wherein the spring sheath has a surface that faces the valve insert, that is substantially planar, and that preferably is only interrupted by the at least one connection line into the interior of the spring sheath.

5. An injector in accordance with claim 1, wherein the placement of the valve insert on the spring sheath takes place in a plane perpendicular to the axis of rotation of the jet needle.

6. An injector in accordance with claim 1, wherein the control chamber comprises two regions or two regions that are only connected to one another by at least one connection line extending in the spring sheath.

7. An injector in accordance with claim 2, wherein the at least one connection line is a bore that preferably extends in parallel with the longitudinal direction of the jet needle.

8. An injector in accordance with claim 1, wherein a region for the placement of the valve insert on the spring sheath is a flat seal that closes the line extending in the valve insert in a placed state of the valve insert on the spring sheath.

9. An injector in accordance with claim 3, wherein the valve insert has a projecting step at the side facing the spring sheath and the opening of the line is arranged in its surface.

10. An injector in accordance with claim 9, wherein the projecting step is a step-like elevation with respect to the remaining side of the valve insert facing the spring sheath so that the contact surface is reduced on a placement on the spring sheath.

11. An injector in accordance with the invention, wherein the valve opening has at least one feed line for high pressure fuel whose connection in the control chamber is open on a placement of the valve insert on the spring sheath and is closed in a state raised therefrom.

12. An injector in accordance with claim 1, wherein the valve insert is formed in mushroom shape.

13. An injector in accordance with claim 1, wherein the line is a discharge throttle for fuel from the control chamber into the valve chamber.

14. An injector in accordance with claim 1, wherein the valve insert is rotationally symmetrical about a bore axis of the line.

15. An injector in accordance with claim 1, wherein the spring sheath is rotationally symmetrical about the axis of rotation of the jet needle.

16. A fuel injector comprising:
a seat plate having a passage throttle;
a valve insert arranged at a first side of the seat plate;
a valve guide surrounding the valve insert and adapted for slidable reception of the valve insert;
a spring sheath surrounding at least a section of a jet needle arranged at a second side of the valve insert, the second side opposite the first side and the seat plate;
a valve chamber fluidly connected to the passage throttle;
a control chamber adapted for reception of fuel; and
a line arranged in the valve insert connecting the control chamber and the valve chamber to one another, wherein the line is closeable by placement of the valve insert onto the spring sheath.

17. The injector of claim 16, wherein the valve chamber is bounded by the seat plate, the valve guide, and the valve insert and extends to the passage throttle of the seat plate.

18. The injector of claim 16, wherein the control chamber is bounded by the valve insert, the valve guide, the spring sheath, and the jet needle.

19. The injector of claim 16, wherein the spring sheath comprises a blind hole sized to receive the at least one section of the jet needle, and wherein the spring sheath comprises at least one connection line adapted to fluidically connect the interior of the blind hole in which the jet needle is arranged to the second side of the valve insert facing the spring sheath.

20. The injector of claim 16, wherein the spring sheath has a placement surface for the placement of the valve insert that, on a placement of the valve insert, closes the line in interaction with a contact surface of the valve insert surrounding an opening of the line.

* * * * *